United States Patent [19]

Smith

[11] Patent Number: 5,070,803

[45] Date of Patent: Dec. 10, 1991

[54] METHOD AND APPARATUS FOR REDUCING THE TROLLING SPEED OF BOATS HAVING INBOARD ENGINES

[76] Inventor: Gene A. Smith, P.O. Box 179, Shallotte, N.C. 28459

[21] Appl. No.: 608,007

[22] Filed: Nov. 1, 1990

[51] Int. Cl.[5] ..... B63H 25/48

[52] U.S. Cl. ..... 114/145 A; 114/145 R

[58] Field of Search ..... 114/145 R, 145 A; 440/40, 43

[56] References Cited

U.S. PATENT DOCUMENTS

| | | | |
|---|---|---|---|
| 947,833 | 2/1910 | Lund | 114/145 R |
| 1,257,165 | 2/1918 | Westendarp | 114/145 R |
| 1,382,809 | 6/1921 | Stewart | 114/145 R |
| 2,256,898 | 9/1941 | Ehmke | 114/145 A |
| 2,719,503 | 10/1955 | Smith | 114/145 A |
| 2,751,875 | 6/1956 | Henry | 114/145 A |
| 2,916,005 | 12/1959 | Parsons | 114/145 R |
| 3,117,548 | 1/1964 | Rasmussen | 114/145 A |
| 3,136,280 | 6/1964 | Bergum | 114/145 A |
| 3,730,127 | 5/1973 | Pedersen | 114/145 A |

*Primary Examiner*—Sherman D. Basinger
*Assistant Examiner*—Thomas J. Brahan
*Attorney, Agent, or Firm*—W. Thad Adams, III

[57] ABSTRACT

A trolling speed reduction apparatus for slowing the trolling speed of boats having an inboard engine and a steerable rudder mounted under the stern of the boat aft of a propeller driven by the inboard engine. The rudder has first and second opposed major sides and has first and second deflector plates carried on opposite sides of the rudder. The deflector plates are moveable between a first, closed position wherein the first and second deflector plates reside closely adjacent to an substantially along the respective first and second major sides of the rudder and are substantially inoperative and a second, open position wherein the first and second deflector plates extend outwardly away from the opposed sides of the rudder into the wash from the propeller and are operative to create speed reducing drag to slow the forward movement of the boat.

14 Claims, 7 Drawing Sheets

METHOD AND APPARATUS FOR REDUCING THE TROLLING SPEED OF BOATS HAVING INBOARD ENGINES

TECHNICAL FIELD AND BACKGROUND OF THE INVENTION

This invention relates to a method and apparatus of reducing the trolling speed of boats having inboard engines The invention has particular application to fishing boats which often are used to troll for fish using live bait. Inboard engines have a minimum idle r.p.m. below which the engine will either stall or overheat. This idle r.p.m. generally ranges between 600 and 800 r.p.m., and translates to an idle speed of approximately 3–4 knots. This speed is substantially too fast for effective fishing according to the trolling method, because the boat is moving so fast that the live bait drowns.

There are two known prior art methods of reducing the trolling speed of boats with inboard engines. One method involves the installation of a trolling valve on the gear redirects hydraulic fluid allowing the clutch of the gear to slip, thereby reducing the output r.p.m. of the shaft. As noted above, this can cause mechanical problems with the gear. In addition, trolling valves reduce the trolling speed of the boat only about 30%.

The other method involves repeatedly putting the transmission into and out of gear. This creates substantial additional wear on the transmission.

There is a method of reducing the speed of outboard engines on much smaller boats which involves hanging a baffle plate in the propeller wash of the outboard engine. The baffle plate is mounted on the drive housing above the propeller and is vertically moveable between a raised position in the water but out of the propeller wash, and a lowered position in the water in the propeller wash. The baffle plate is raised and lowered by a cable which connects to the baffle plate and extends into the boat. This device is shown in U.S. Pat. No. 3965838. This type of device is not practical for large boats of the type which have inboard engines.

The present invention provides an effective means of safely reducing the trolling speed of boats having inboard engines without modifications to the gear or to the engine operation.

SUMMARY OF THE INVENTION

Therefore, it is an object of the invention to provide an apparatus for reducing the trolling speed of boats having inboard engines.

It is another object of the invention to provide an apparatus for reducing the trolling speed of boats having inboard engines without modifications to the boat engine or gear.

It is another object of the invention to provide an apparatus for reducing the trolling speed of boats having inboard engines without modifications to the manner of operating the boat gear or engine.

It is another object of the invention to provide an apparatus for reducing the trolling speed of boats having inboard engines and moveable between an operable and an inoperable position by controlled variation in the speed and direction of travel of the boat.

It is another object of the invention to provide an apparatus for reducing the trolling speed of boats having inboard engines and moveable between an operable and an inoperable position without auxiliary controls.

These and other objects of the present invention are achieved in the preferred embodiments disclosed below by providing a trolling speed reduction apparatus for slowing the trolling speed of boats having an inboard engine and a steerable rudder mounted under the stern of the boat aft of a propeller driven by the inboard engine, the rudder having first and second opposed major sides and comprising first and second deflector plates carried on opposite sides of the rudder and moveable between a first, closed position wherein the first and second deflector plates reside closely adjacent to and substantially along the respective first and second major sides of the rudder and are substantially inoperative and a second, open position wherein the first and second deflector plates extend outwardly away from the opposed sides of the rudder into the wash from the propeller and are operative to create speed reducing drag to slow the forward movement of the boat.

According to one preferred embodiment of the invention, the apparatus includes pivot means for pivotally mounting the first and second deflector plates to the rudder for pivotal movement of the first and second deflector plates between the operative and inoperative positions.

According to another preferred embodiment of the invention, the apparatus includes tension means for maintaining the first and second deflector plates in the outwardly extending operative position during slow speed forward movement of the boat.

According to another preferred embodiment of the invention, the apparatus includes pivot means securing one end of the first and second deflector plates to a forward end of the rudder thereby enabling the first and second deflector plates to each pivot outwardly away from the rearward end of the rudder towards the forward end of the rudder and tension means for maintaining the first and second deflector plates in the outwardly extending operative position towards the forward end of the rudder during slow speed, forward movement of the boat and for retracting the first and second deflector plates into the closed inoperative position at a forward boat speed above a predetermined slow forward speed.

According to yet another preferred embodiment of the invention, the apparatus includes pivot means securing one end of the first and second deflector plates to a forward end of the rudder thereby enabling the first and second deflector plates to each pivot outwardly away from the rearward end of the rudder towards the forward end of the rudder and tension means for maintaining the first and second deflector plates in the outwardly extending operative position towards the forward end of the rudder during slow speed, forward movement of the boat and for retracting the first and second deflector plates into the closed inoperative position at a forward boat speed above a predetermined slow forward speed. The apparatus also includes first and second base plates mounted on respective first and second sides of the rudder and carrying the respective deflector plates.

Preferably, the tension means comprises first and second elongate spring means, one end of which is mounted on the outermost extending end of respective deflector plates and the other end of which is mounted on the respective one of the first or second base plates.

Preferably, the first and second spring means each comprise an elongate adjustable tension rod and a normally compressed spring.

According to one preferred embodiment of the invention, the first and second base plates each include a connecting bar carrying a respective spring means and being mounted for pivotal movement on the base plate and moveable between a first position wherein the deflector plates are in their respective inoperative position along the rudder and the spring is in a normally compressed condition and a second position wherein the deflector plates are in their respective operative position extending outwardly from the rudder and the spring is in a tensioned, over-center condition thereby tensioning the deflector plates in their outwardly extending open position in resistance to a predetermined slow speed forward movement of the boat.

Preferably, the invention includes a push bar connecting the deflector plate and the connecting bar for moving the connecting bar between the first and second positions.

According to another preferred embodiment of the invention, the deflector plates are moveable from their inoperative into their operative position by the action of dynamic water pressure against the deflector plates when the boat is moving in reverse direction through the water at or above a predetermined slow reverse direction speed.

Preferably, the apparatus includes actuation means for moving the deflector plates from their inoperative position into their operative position.

According to another preferred embodiment of the invention, the actuation means comprises the pivot means mounting the respective first and second deflector plates to the rudder, an inner surface of the first and second deflector plates facing the respective side of the rudder, the respective side of the rudder facing the inner surface of the respective deflector plate and a predetermined space between the inner surfaces and the respective side of the rudder to resist water flow therethrough when the boat is moving in reverse direction through the water at or above a predetermined slow reverse direction speed.

An embodiment of the method according to the invention of slowing the trolling speed of boats having an inboard engine and a steerable rudder mounted under the stern of the boat aft of a propeller driven by the inboard engine, the rudder having first and second opposed major sides, the speed reduction method comprises the steps of providing first and second deflector plates carried on opposite sides of the rudder, moving the first and second deflector plates to a first, closed position wherein the first and second deflector plates reside closely adjacent to and substantially along the respective first and second major sides of the rudder and are substantially inoperative, and moving the first and second deflector plates to a second, open position wherein the first and second deflector plates extend outwardly away from the opposed sides of the rudder into the wash from the propeller and are operative to create speed reducing drag to slow the forward movement of the boat.

Preferably, the invention includes the step of pivotally mounting the first and second deflector plates to the rudder for pivotal movement of the first and second deflector plates between the operative and inoperative positions.

Another embodiment of the method according to the invention of slowing the trolling speed of boats having an inboard engine includes the step of providing tension means for maintaining the first and second deflector plates in the outwardly extending operative position during slow speed forward movement of the boat.

Preferably, the invention includes the steps of providing pivot means securing one end of the first and second deflector plates to a forward end of the rudder thereby enabling the first and second deflector plates to each pivot outwardly away from the rearward end of the rudder towards the forward end of the rudder and tension means for maintaining the first and second deflector plates in the outwardly extending operative position towards the forward end of the rudder during slow speed, forward movement of the boat and for retracting the first and second deflector plates into the closed inoperative position at a forward boat speed above a predetermined slow forward speed.

According to one preferred embodiment of the invention, the method includes the step of reversing the direction of the boat through the water at or above a predetermined slow speed to move the deflector plates from their inoperative into their operative position by the action of dynamic water pressure against the deflector plates.

According to another preferred embodiment of the invention, the method includes the step of retracting the first and second deflector plates into the closed inoperative position by operating the boat at a forward boat speed above a predetermined slow forward speed.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Assembly

Figure 1:
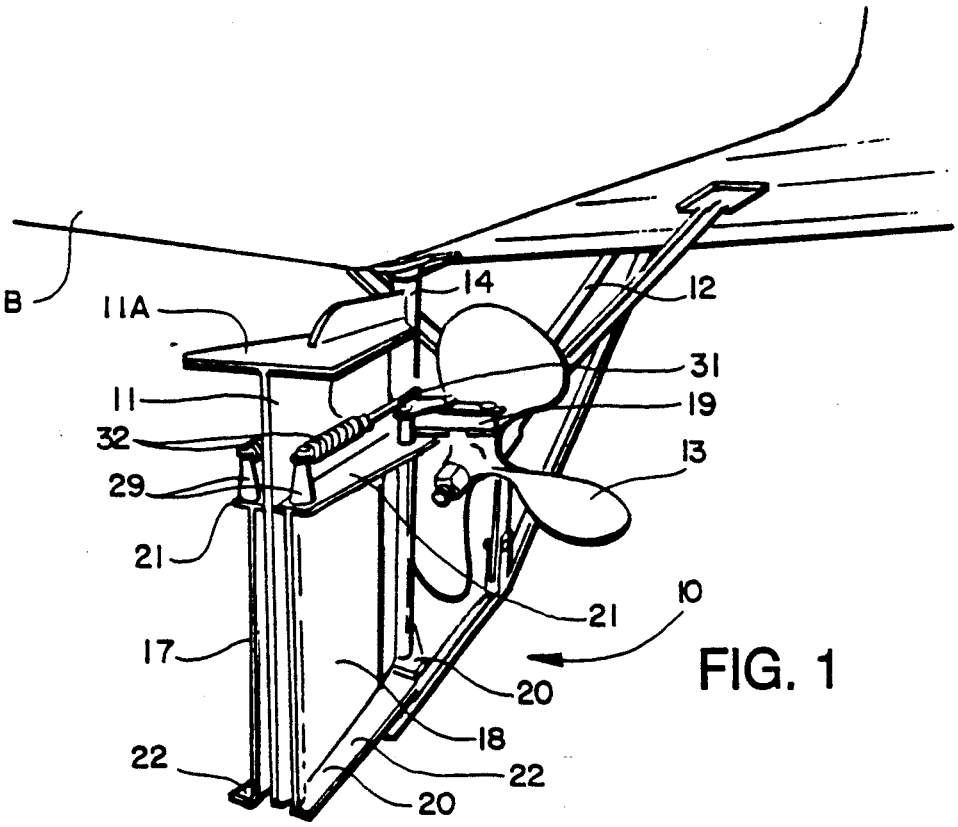
FIG. 1 is a perspective view of the aft section of a boat equipped with a trolling speed reducer 10 according to an embodiment of the invention, the trolling speed reducer 10 being in its closed, inoperative position.
Figure 2:
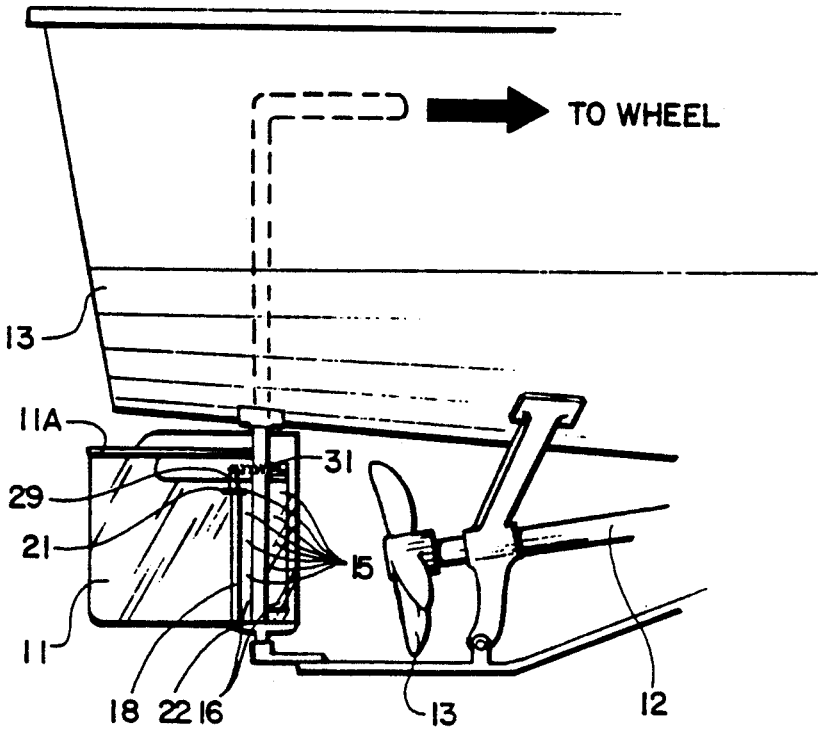
FIG. 2, is a side elevation view of the trolling speed reducer 10 shown in FIG. 1, the trolling speed reducer 10 being in its open, operative position.

Referring now specifically to the drawings, a trolling speed reducer 10 according to the present invention is illustrated in FIGS. 1 and 2, and shown generally at reference numeral 10. The trolling speed reducer 10 is mounted on the rudder "11" of a boat "B." The particular rudder 11 shown in the drawings includes diverter plate 11A mounted along the length of the top edge of the rudder and fans out towards the trailing edge of the rudder. However, the diverter plate is not a part of the trolling speed reducer 10 per se. The boat "B" is a boat of a type which has in inboard motor, not shown, and which is driven through a propeller shaft 12 on which is mounted a drive propeller 13. Rudder 11 is mounted on a rudder stock 14 aft of the propeller in its wash. It is the movement of the water propelled by propeller 13 past the rudder 11, and the ability of the rudder 11 to be turned on the stock 14 which provides steering to the boat "B". Trolling speed reducer 10 is mounted on rudder 11 by bolts 15 which extend through mounting plates 16 on both sides of rudder 11.

Figure 3:
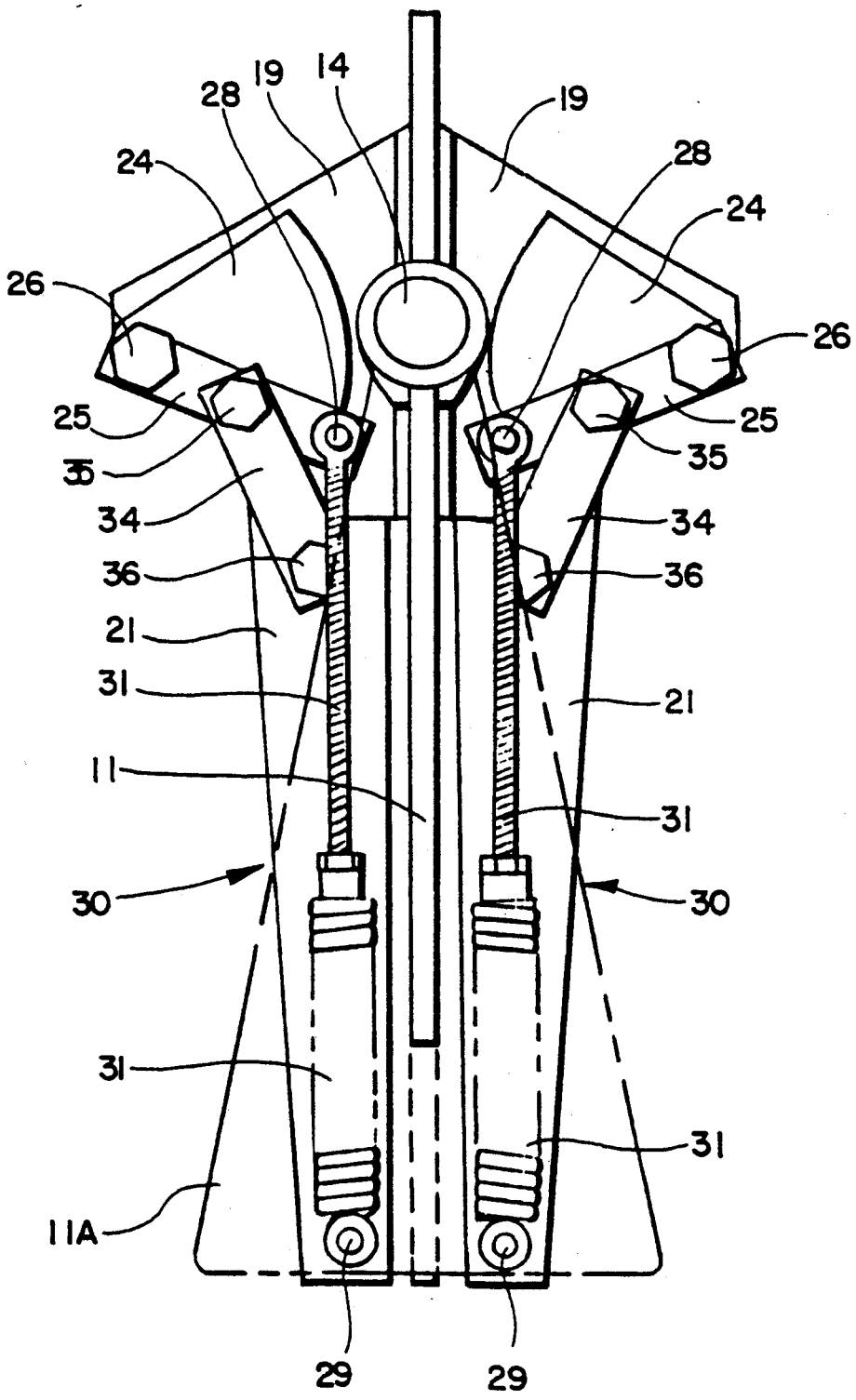
FIG. 3 is a top plan view of the trolling speed reducer 10 in its closed, inoperative position.
Figure 4:
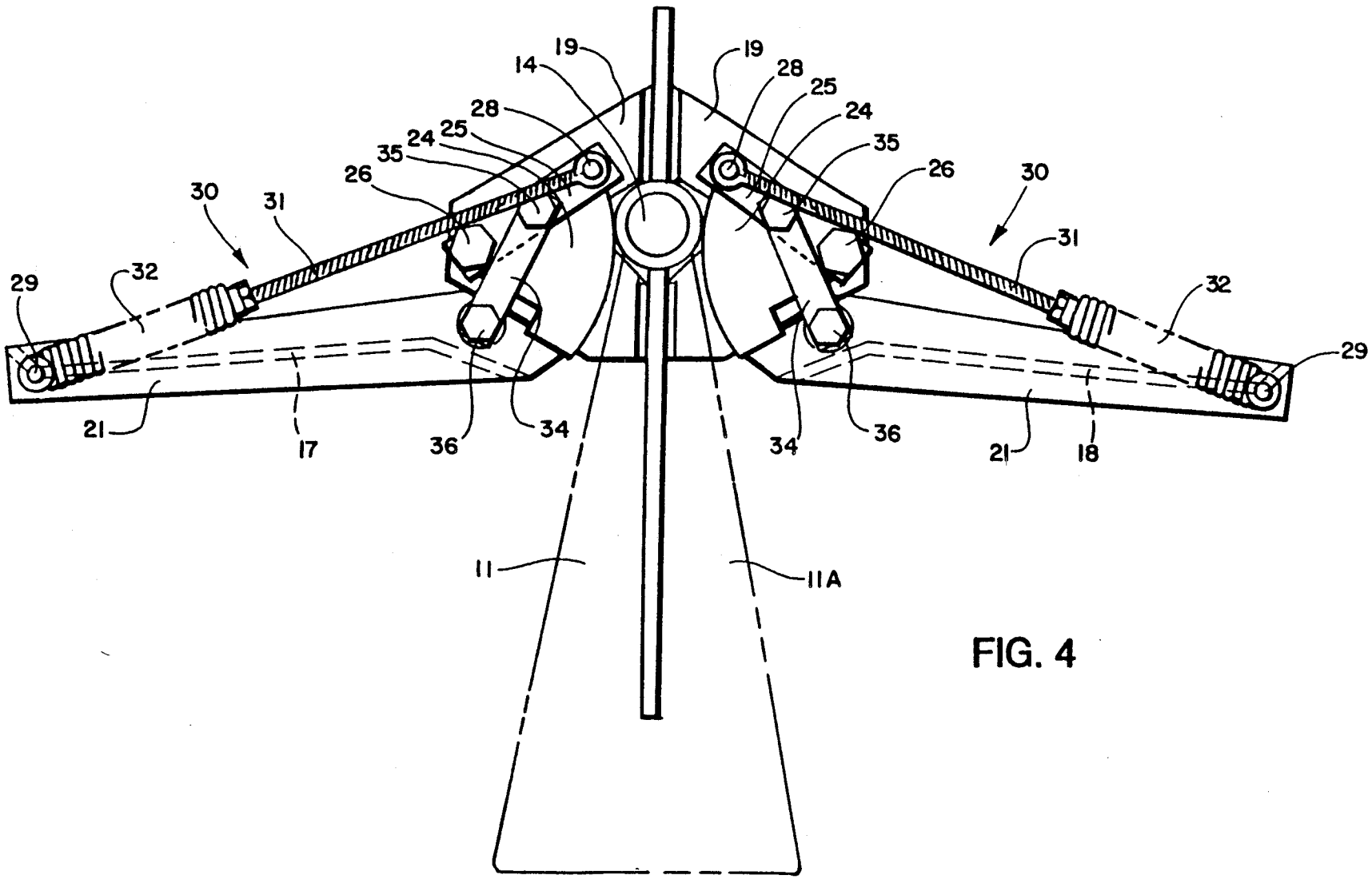
FIG. 4 is a top plan view of the trolling speed reducer 10 in its open, operative position.
Figure 5:
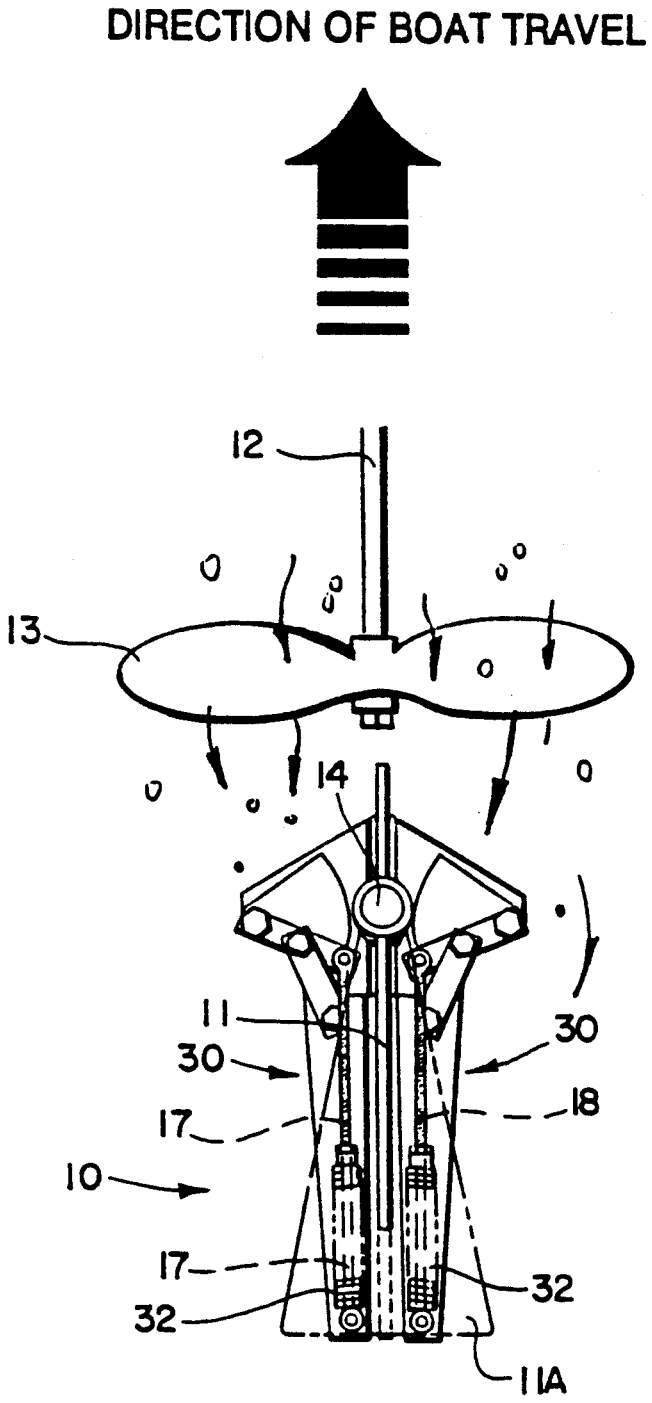
FIG. 5 is a top plan view of the trolling speed reducer 10 in its closed, inoperative position, and showing movement of the boat and the water in relation to the configuration of the trolling speed reducer 10 in its inoperative position.

As is shown in FIGS. 3 and 4, a pair of deflector plates 17 and 18 are mounted on opposite sides of rudder 11 by respective upper and lower base plates 19, 20. Deflector plates 17, 18 are supported between respective upper and lower laterally extending flanges 21, 22. The deflector plates 17, 18, as shown in FIG. 1, flare outwardly slightly at the rear and inwardly at the front (nearest propeller 13).

The upper and lower base plates 19 and 20 permit the deflector plates 17 and 18 to pivot inwardly to the position shown in FIGS. 1 and 3, and outwardly to the position shown in FIGS. 2 and 4.

The upper base plates 19 each support a torque stabilizer 24 which prevents twisting of the portions of the trolling speed reducer 10 under tension, as described below. A connecting bar 25 is mounted on each of the torque stabilizers 24 and pivots about an axis defined by a shoulder bolt 26. The opposite end of each connecting bar 25 carries a stud 28. A stud 29 is carried by the outer end of each of the two upper flanges 21. An adjustable tension rod 30 is pivotally mounted between studs 28, 29 on both of the upper flanges 21, as is shown in several of the drawings but best shown in FIGS. 3 and 4. The two tension rods 30 are each formed of a length of steel rod 31 (which may or may not be threaded) connected to a powerful steel spring 32.

Push bars 34 interconnect the connecting bars 25 and the inner end of the upper flanges 21 on both of the deflector plates 17, 18. One end of each of the push bars 34 is pivotally mounted on respective connecting bars 25 by a respective shoulder bolt 35 and the other end of push bars 34 is pivotally mounted on the inner end of the upper flanges 21 of deflector plates 17 and 18 by a respective shoulder bolt 36.

Deflector plates 17 and 18 are normally held by respective springs 32 in an over-center position against rudder 11, as is shown in FIG. 3. Sufficiednt pressure against the deflector plates 17 and 18 overcomes the tension of the springs 32 and permits the deflector plates to move into the position shown in FIG. 4. Movement of the connecting bars 25 into the position shown in FIG. 4 stretches springs 32 by increasing the distance between the opposite ends of the tension rods 30. In the particular trolling speed reducer 10 shown in the drawing Figures, the distance between pivots 28 and 29 increases from about 7.5 inches to about 9 inches when the deflector plates 17 and 18 are moved into the open position shown in FIG. 4. This increases the tension on the springs 32 and exerts a strong pull of the deflector plates 17 and 18 into an open over-center position as shown in FIG. 4.

Operation

As is apparent from the above description, no actuation mechanism is provided by which the boat operator can directly move the trolling speed reducer 10 between the closed and open positions shown in FIGS. 3 and 4, respectively. While such controls could be provided, the trolling speed reducer 10 is designed to permit operation of the trolling speed reducer 10 without the need of a separate actuation mechanism. Rather, the boat operator actuates the trolling speed reducer 10 by manipulation of the wheel and throttle of the boat. This simplifies the structure of the trolling speed reducer 10, reduces the number of parts which may break, wear or corrode and eliminates the possibility of actuator malfunction which would prevent movement of the deflector plates 17, 18 into or out of operation.

Operation of trolling speed reducer 10 is illustrated in FIGS. 5–8. In normal operation of the boat the trolling speed reducer 10 is in the configuration shown in FIG. 5, without regard to the boat's forward or rearward speed The trolling speed reducer 10 has little or no effect on normal speed operation of the boat in either the forward or aft direction. The deflector plates 17, 18 hug the opposite sides of the rudder 11 and act as a rudder.

Figure 6:
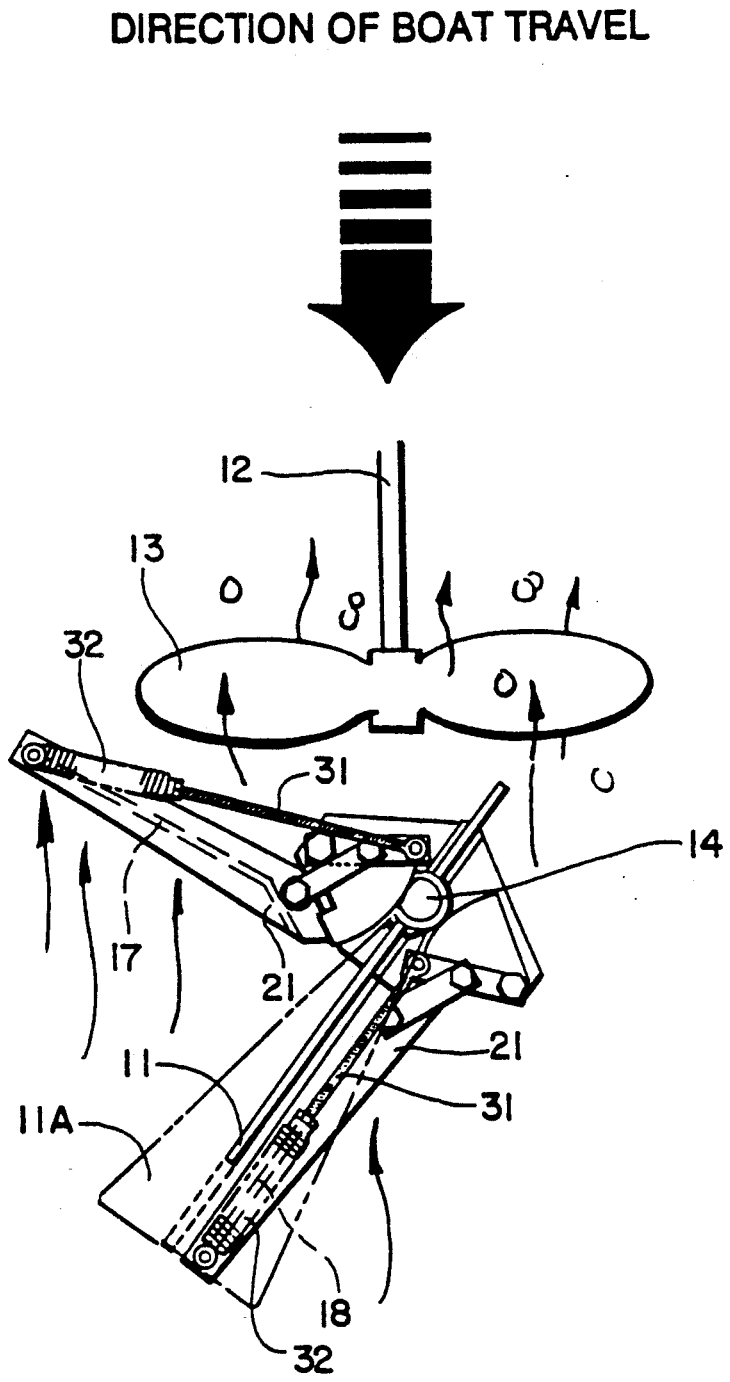
FIGS. 6 and 7 are top plan views showing movement of the trolling speed reducer 10 into operative position by movement of the rudder.

When slow speed trolling is desired, the boat is placed in reverse at a relatively slow speed, for example about 3 or 4 knots, and the wheel is turned to place the boat in a sharp turn to port. As is shown in FIG. 6, the aft movement of the boat combined with the turn to port places deflector plate 17 in a position relative to the flow of water past the rudder 11 where the pressure of the water flow overcomes the pull of the spring 32 on deflector plate 17, causing deflector plate 17 to move into the position shown in FIG. 6. When deflector plate 17 moves past its over-center position the spring 32 holds tension rod 30 and deflector plate 17 in an open over-center position as shown in FIG. 4.

Figure 7:
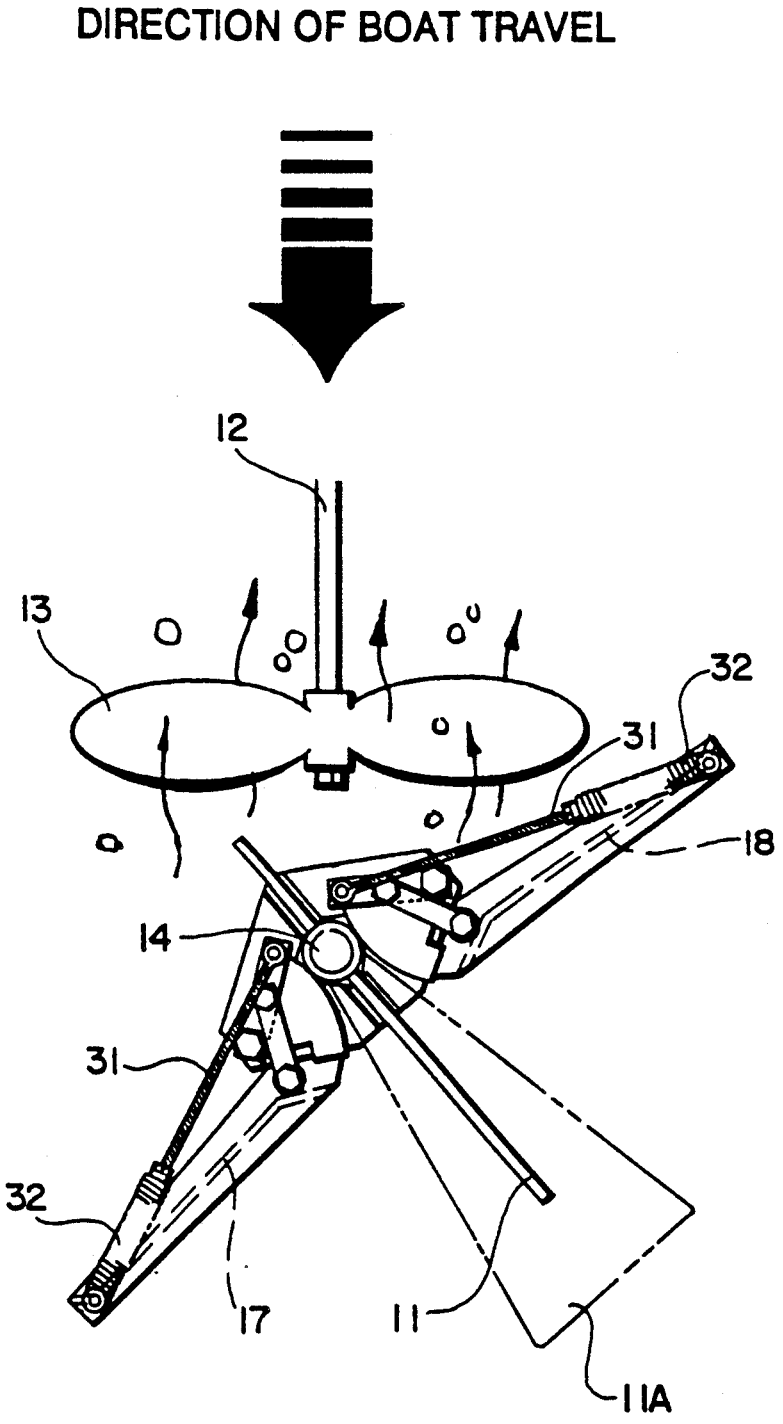

With deflector plate 17 in the position shown in FIG. 6, the wheel is turned hard to starboard to position the rudder 11 in the position in FIG. 7. As is shown in FIG. 7, the aft movement of the boat combined with the turn to starboard places deflector plate 18 in a position relative to the flow of water past the rudder 11 where the pressure of the water flow overcomes the pull of the spring 32 on deflector plate 18, causing deflector plate 18 to move into the position shown in FIG. 7. When deflector plate 18 moves past its over-center position the spring 32 holds tension rod 30 and deflector plate 18 in an open over-center position as shown in FIG. 4.

With trolling speed reducer 10 in the position shown in FIGS. 4 and 7, forward movement of the boat is resumed. At minimum throttle position the trolling speed reducer 10 reduces the speed of the boat through the water by about 50%. This is in contrast to the effect of a conventional trolling valve installed in the gear which, in addition to all of the problems referred to above, reduces the trolling speed by only about one third.

As long as the speed of the boat through the water is maintained at about 2 knots or less, the configuration shown in FIGS. 4 and 7 is maintained. The boat is steered in the normal fashion. The rudder 11 is fully effective. The boat may also be placed into reverse movement. The aft direction of the boat is also reduced substantially by the trolling speed reducer 1 while permitting completely normal steering.

Figure 8:
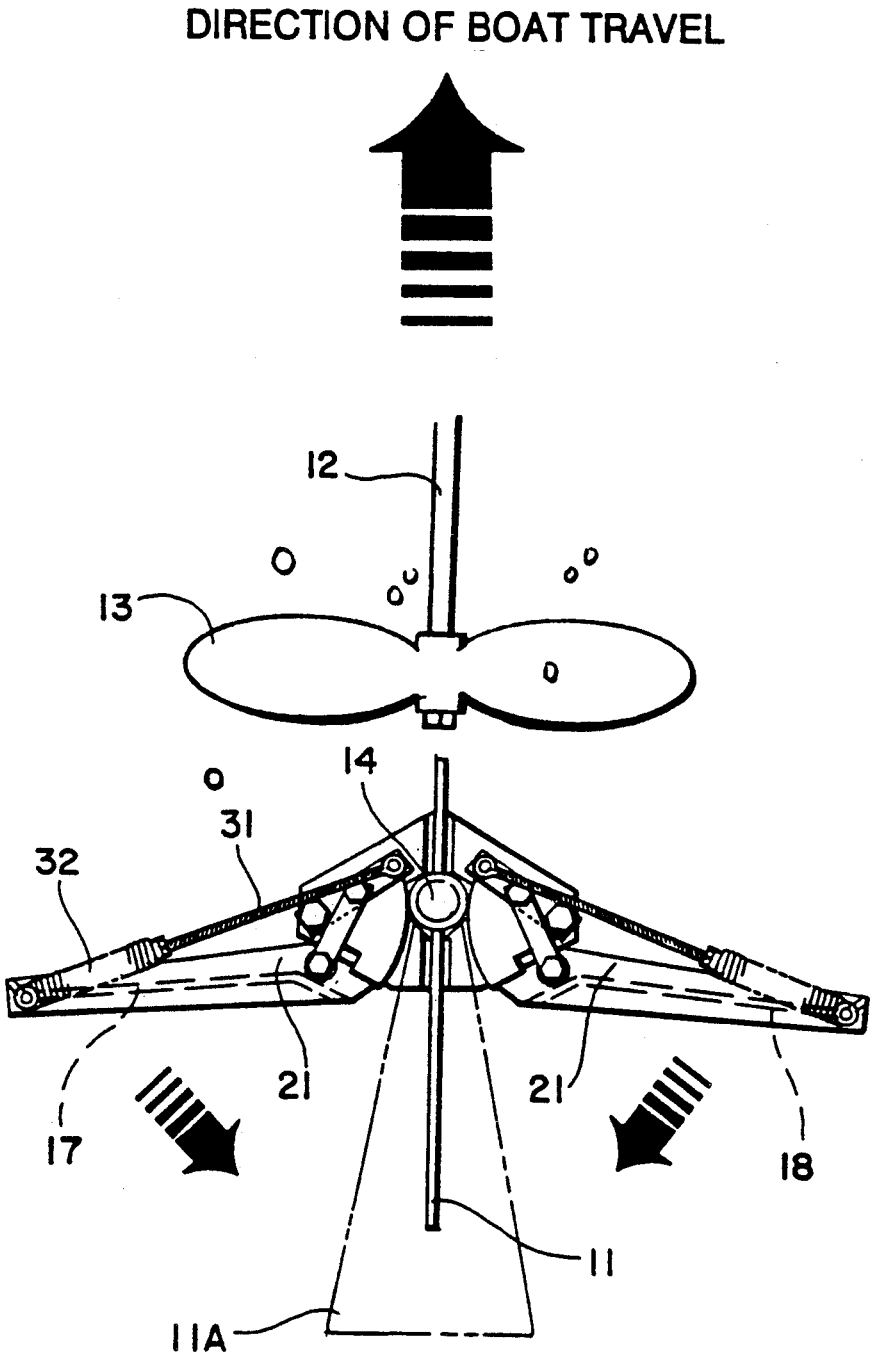
FIG. 8 is a top plan view showing movement of the trolling speed reducer 10 into its inoperative position.

Whenever cruising speed is desired, the throttle is increased to increase the forward speed of the boat. At a given speed slightly above the desired trolling speed the water pressure against the forward surface of the deflector plates 17 and 18 overcomes the pull of springs 32 and as is illustrated in FIG. 8, forces the deflector plates 17 and 18 rearwardly into the position shown in FIG. 3.

Adjustment of the deflector plates 17 and 18 and consequently the pull of the springs 32 is accomplished by adjusting the tension of the springs 32.

A trolling speed reducer for a boat is described above. Various details of the invention may be changed without departing from its scope. Furthermore, the foregoing description of the preferred embodiment of the invention and the best mode for practicing the invention are provided for the purpose of illustration only and not for the purpose of limitation--the invention being defined by the claims.

I claim:

1. A trolling speed reduction apparatus for slowing the trolling speed of boats having an inboard engine and a steerable rudder mounted under the stern of the boat aft of a propeller driven by the inboard engine, said rudder having first and second opposed major sides, said speed reduction apparatus comprising:

(a) first and second deflector plates carried on opposite sides of said rudder and moveable between:

(i) a first, closed position wherein said first and second deflector plates reside closely adjacent to and substantially along the respective first and second major sides of the rudder and are substantially inoperative; and (ii) a second, open position wherein said first and second deflector plates extend outwardly away from the opposed sides of said rudder into the wash from the propeller and are operative to create speed reducing drag to slow the forward movement of the boat;

(b) pivot means securing one end of said first and second deflector plates to said rudder for pivotal movement between the first, closed position and the second, open position; and (c) tension means carried by said deflector plates for normally maintaining said deflector plates in their closed, inoperative position, whereby overcoming said tension means by dynamic water pressure when the boat is moving in reverse direction through the water at or above a predetermined slow reverse direction speed permits movement of said deflector plates from their inoperative to their operative positions.

2. A trolling speed apparatus according to claim 1, wherein said first and second deflector plates are each independently moveable between their respective open and closed positions.

3. A trolling speed reduction apparatus according to claim 1, and including:

(a) first and second base plates mounted on respective first and second sides of the rudder and carrying said respective deflector plates.

4. A trolling speed reduction apparatus according to claim 3, wherein said tension means comprises first and second elongate spring means, one end of which is mounted on the outermost extending end of respective deflector plate and the other end of which is mounted on the respective one of the first or second base plates.

5. A trolling speed reduction apparatus according to claim 4, wherein said first and second spring means each comprise an elongate adjustable tension rod and a normally compressed spring.

6. A trolling speed reduction apparatus according to claim 5, wherein said first and second base plates each include a connecting bar carrying a respective spring means and being mounted for pivotal movement on said base plate and moveable between:

(a) a first position wherein the deflector plates are in their respective inoperative position along the rudder and the spring is in a normally compressed condition; and (b) a second position wherein the deflector plates are in their respective operative position extending outwardly from the rudder and the spring is in a tensioned, over-center condition thereby tensioning said deflector plates in their outwardly extending open position in resistance to a predetermined slow speed forward movement of the boat.

7. A trolling speed reduction apparatus according to claim 6, and including a push bar connecting said deflector plate and said connecting bar for moving said connecting bar between said first and second position.

8. A trolling speed reduction apparatus according to claim 1, and including actuation means for moving said deflector plates from their inoperative position into their operative position.

9. A trolling speed reduction apparatus according to claim 8, wherein said actuation means comprises:

(a) the pivot means mounting said respective first and second deflector plates to said rudder;

(b) an inner surface of said first and second deflector plates facing the respective side of said rudder;

(c) the respective side of said rudder facing the inner surface of the respective deflector plate; and (d) a predetermined space between (b) and (c) to resist water flow therethrough when the boat is moving in reverse direction through the water at or above a predetermined slow reverse direction speed.

10. A method of slowing the trolling speed of boats having an inboard engine and a steerable rudder mounted under the stern of the boat aft of a propeller driven by the inboard engine, said rudder having first and second opposed major sides, said speed reduction method comprising the steps of:

(a) providing first and second deflector plates carried on opposite sides of said rudder;

(b) moving the first and second deflector plates to a first, closed position wherein said first and second deflector plates are tensioned to reside closely adjacent to and substantially along the respective first and second major sides of the rudder and are substantially inoperative; and (c) moving the first and second deflector plates to a second, open position wherein said first and second deflector plates extend outwardly away from the opposed sides of said rudder into the wash from the propeller by overcoming tension on said deflector plates by dynamic water pressure against said deflector plates when the boat is moving in reverse direction through the water at or above a predetermined slow reverse direction speed, whereby the deflector plates are operative to create speed reducing drag to slow the forward movement of the boat.

11. A method according to claim 10, wherein the step of providing the deflector plates includes the step of mounting said deflector plates for independent movement between their respective open and closed positions.

12. A method according to claim 11, wherein the step of moving the first and second deflector plates to a second, open position wherein said first and second deflector plates extend outwardly away from the opposed sides of said rudder comprises the steps of:

(a) removing the boat in an aft, reverse direction through the water;

(b) turning the boat hard to port to direct water flow against an inner surface of the port deflector plate to move it into the open, operative position; and (c) turning the boat hard to starboard to direct water flow against an inner surface of the starboard deflector plate to move it into the open, operative position.

13. A method of slowing the trolling speed of boats having an inboard engine according to claim 10, and including the step of pivotally mounting said first and second deflector plates to said rudder for pivotal movement of said first and second deflector plates between the operative and inoperative positions.

14. A method of slowing the trolling speed of boats having an inboard engine according to claim 10 and including the step of retracting said first and second deflector plates into the closed inoperative position by operating the boat at a forward boat speed above a predetermined slow forward speed.

* * * * *